US005088268A

United States Patent [19]

Gunter

[11] Patent Number: 5,088,268

[45] Date of Patent: Feb. 18, 1992

[54] VACUUM PACKAGING APPARATUS

[75] Inventor: Werner Gunter, Horw, Switzerland

[73] Assignee: W. R. Grace & Co. -Conn., Duncan, S.C.

[21] Appl. No.: 605,814

[22] Filed: Oct. 30, 1990

[30] Foreign Application Priority Data

Dec. 22, 1989 [GB] United Kingdom ..... 8929118

[51] Int. Cl.[5] ..... B65B 31/02; B65B 59/02

[52] U.S. Cl. ..... 53/86; 53/97; 53/510

[58] Field of Search ..... 53/86, 97, 110, 434, 53/433, 432, 510, 512

[56] References Cited

U.S. PATENT DOCUMENTS 1,588,079 6/1926 Winters ..... 53/86 X
2,054,492 9/1936 Young ..... 226/68
2,601,020 6/1952 Hopp ..... 226/56
3,928,940 12/1975 Fagniart ..... 53/86 X
4,248,275 2/1981 Reed ..... 53/86 X

FOREIGN PATENT DOCUMENTS 864856 4/1961 United Kingdom .
925564 8/1963 United Kingdom .
2113646 8/1983 United Kingdom .

*Primary Examiner*—James F. Coan
*Attorney, Agent, or Firm*—William D. Lee, Jr.; Mark B. Quatt; Jennifer L. Skord

[57] ABSTRACT

A vacuum chamber has its cover 11 adjustable in height by way of two rams 37 and 38 which lift a chamber cover ceiling 39 relative to a sidewall assembly 35, with the agency of an equalizing cylinder 41 to ensure identical lifting and lowering of the ceiling. During adjustment, an inflatable seal 33 around the periphery of the ceiling 39 is relaxed to allow the sliding movement and then after adjustment the seal 33 is re-inflated to ensure complete sealing between the ceiling 39 and the sidewall assembly 35.

12 Claims, 7 Drawing Sheets

VACUUM PACKAGING APPARATUS

The present invention relates to apparatus for forming a vacuum pack comprising a product enclosed within a container of plastic material. One form of the apparatus can accept a product loaded in a plastic bag, and then subject the interior and the exterior of the bag to vacuum following which the mouth of the bag is sealed to enclose the product under vacuum.

Vacuum packaging apparatus of various sizes and shapes have been known for several decades, but it has frequently been the case that the vacuum chamber in which a vacuum packaging operation is carried out has to be designed for a particular size and shape of product.

This has meant that where one apparatus is intended to accommodate different shapes and/or sizes of product it has been necessary to provide the chamber to be large enough to accept the largest (for example the tallest) of the range of products for which the apparatus is to be used. This is, however, costly in that the apparatus is larger than is usually necessary when smaller products are being handled, and in particular the need for repeated cycling of the vacuum chamber leads to a considerably longer cycle time and increased power consumption through having to evacuate space which is not accommodating product volume except when the very largest product is being used.

One way of cutting down on this expensive vacuum cycling of unnecessarily large volumes is to provide fillers to be positioned within the chamber in order to reduce the vacuum cycling volume. However, insertion and removal of these fillers, normally performed manually, incurs downtime while the apparatus is being adapted from one product height or volume to another. Furthermore the fillers are unlikely to conform closely to the volume remaining between a small product and the walls of the chamber, and lightweight fillers which are the most convenient to use are usually to some extent porous so that some air from the interior of the filler will be extracted when the vacuum is applied.

An alternative variation is to incorporate an inflatable membrane within the chamber, so as to inflate the membrane to act as a variable volume filler when any but the largest products are being packaged. However, it has been found that such membranes fail due to the handling they receive during the life of the apparatus on the customer's premises where day-to-day operation is not conducive to gentle treatment of the chamber interior. For example a rubber membrane in the roof of the chamber will inflate to a downwardly convex shape such that there will be a dead space round the periphery of the membrane when the centre of the membrane contacts the top of the product, unless the membrane is so highly stretched when inflated that the centre is liable to rupture on the product or the in-chamber equipment such as sealing means.

Yet a further possibility is to provide for a replaceable chamber cover (the part which is removed and replaced for loading and emptying the chamber) so that a large (e.g. tall) chamber cover is used for large products and a smaller chamber cover is used in its place when smaller products are being packaged, in order to reduce the vacuum cycle energy and cycle time. Furthermore, because of the mass (up to 500 Kg) of the larger chamber covers in current use, this possibility is really only feasible for small vacuum chambers. Manipulation of the larger sized chamber covers would risk injury to the operators and would require lifting tackle and/or a power hoist.

None of these solutions has proved satisfactory in overcoming the problems of economics of vacuum chamber packaging.

It is the object of the present invention to provide a vacuum packaging apparatus including a vacuum chamber which can be readily and rapidly adapted to different product volumes, with a minimum of manual intervention.

Accordingly, the present invention provides a vacuum packaging apparatus comprising a vacuum chamber consisting of a base member and a cover member movable relative to one another for opening and closing the vacuum chamber, wherein at least one of the base member and cover member comprise first and second parts which can be repositioned relative to one another to define at least a minimum chamber volume configuration and a maximum chamber volume configuration, there being a seal between said parts. Preferably the seal is releasable, and means are provided for releasing the seal prior to and during readjustment of the chamber volume and re-engagement of the seal between said parts after selection of a new chamber volume.

Preferably said releasable seal comprises a releasable sealing member carried by said second part and which can be applied firmly against said first part after the chamber cover volume has been altered, but can be released from said first part before the vacuum chamber volume is to be altered.

In order that the present invention may more readily be understood the following description is given, merely by way of example, with reference to the accompanying drawings in which.

Figure 1:
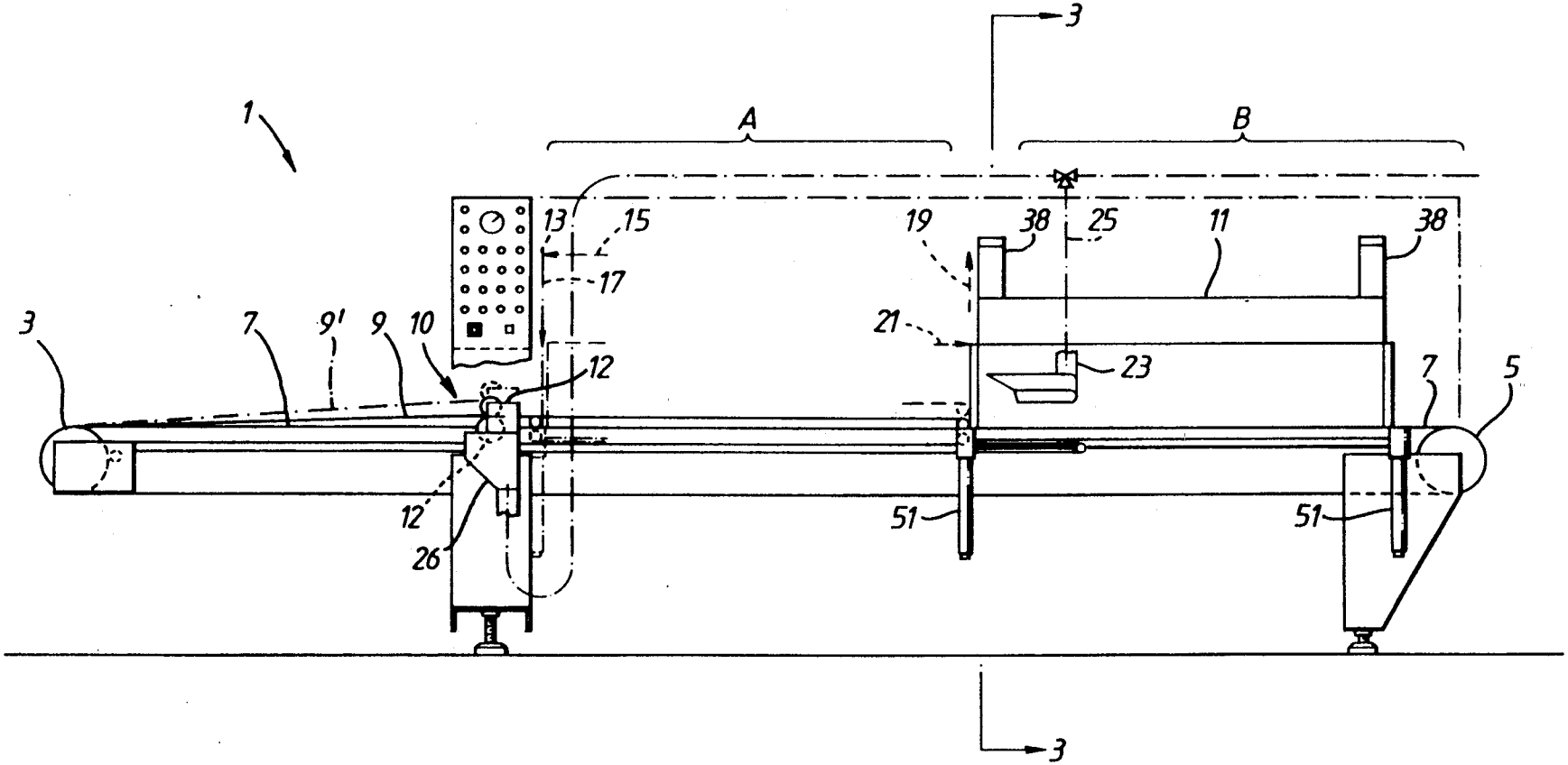
FIG. 1 is a side elevational view, partly schematic, of a packaging apparatus in accordance with the present invention.
Figure 2:
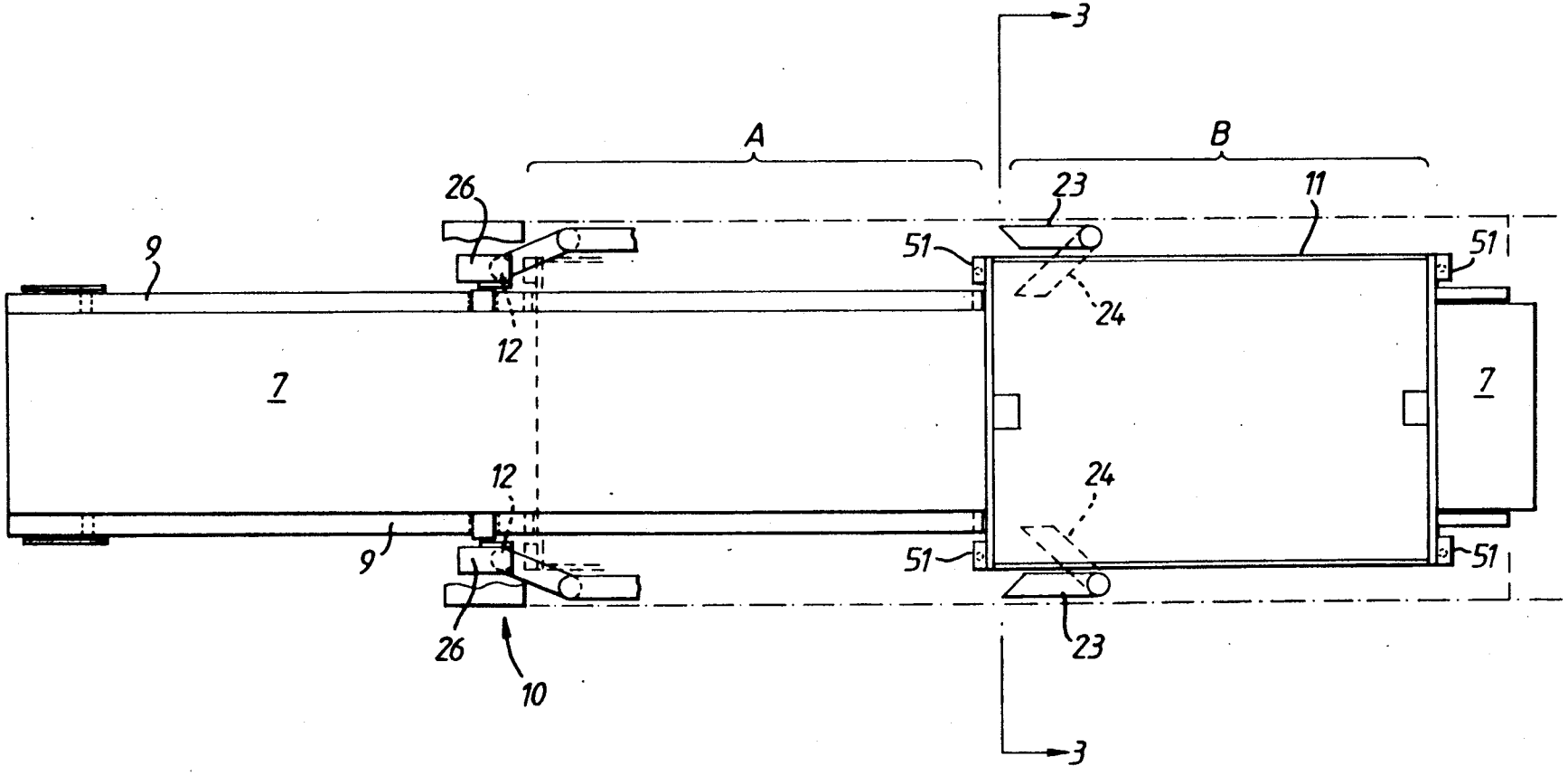
FIG. 2 is a top plan view of the apparatus of FIG. 1.
Figure 3:
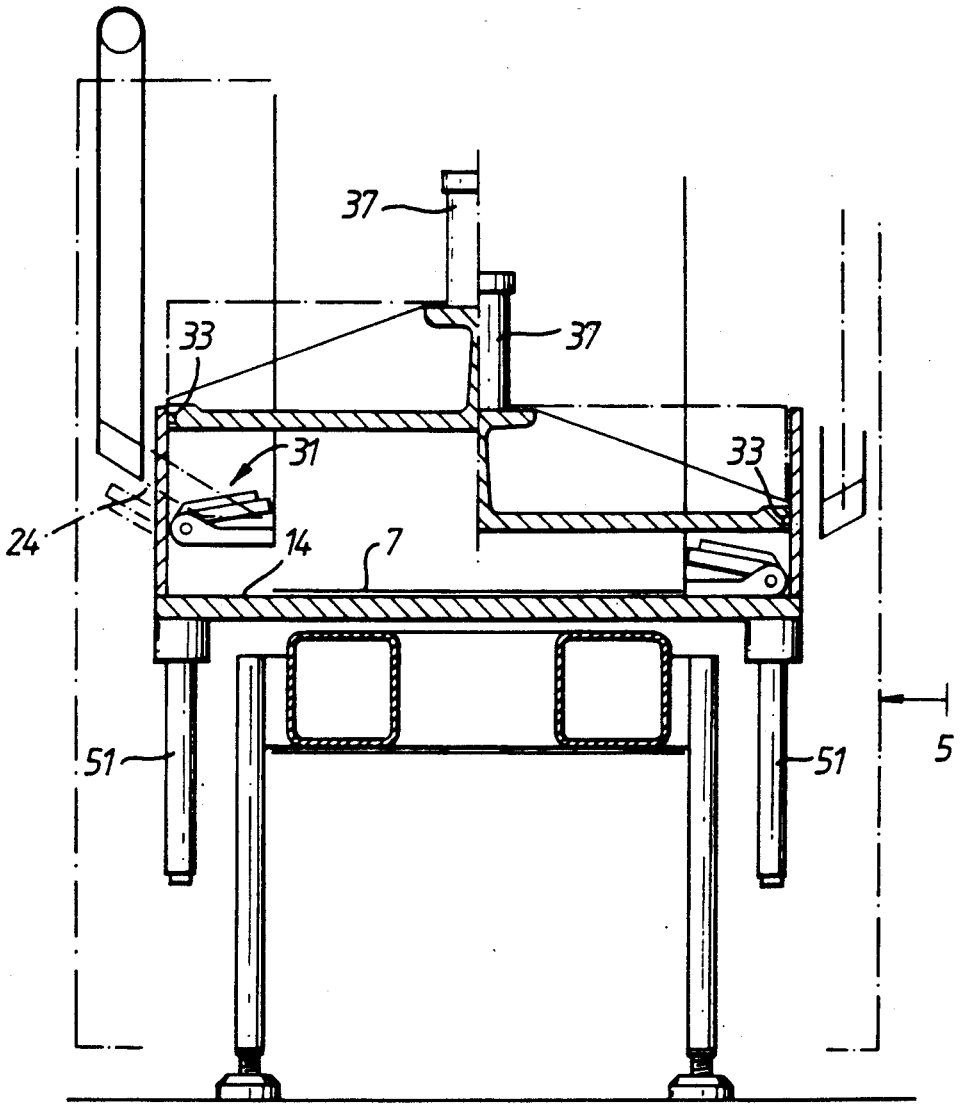
Figure 4:
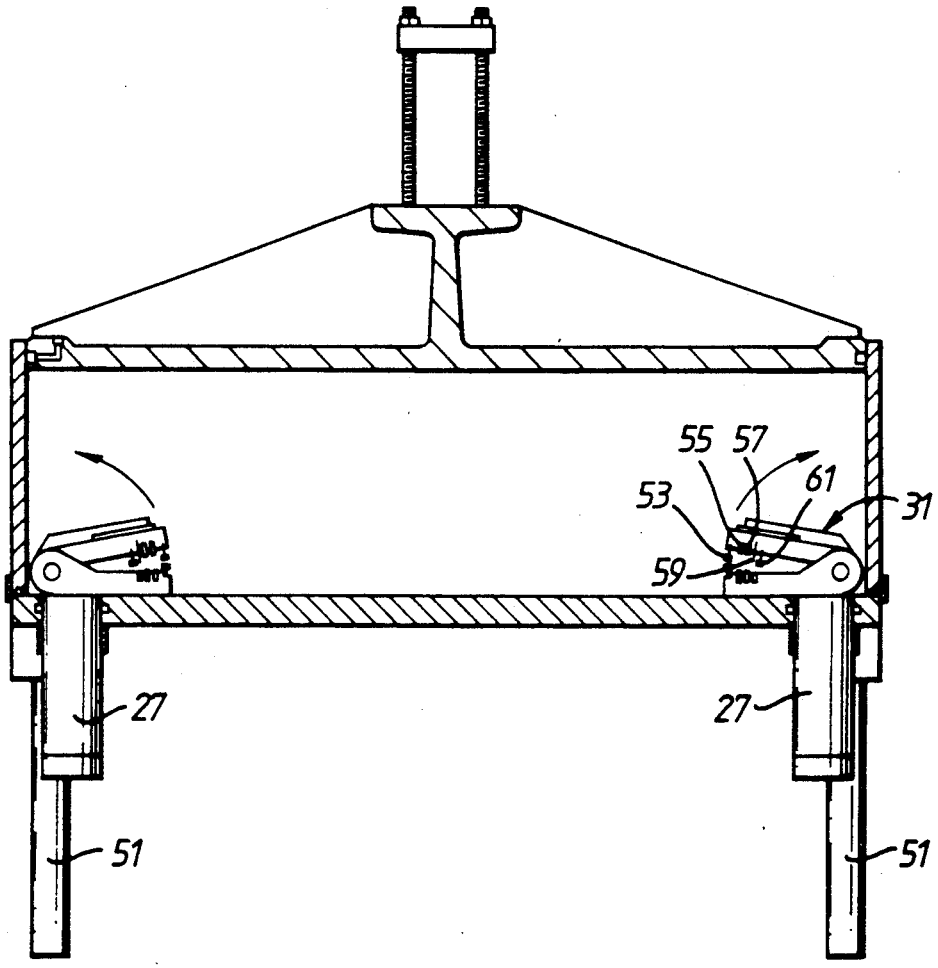
Figure 5:
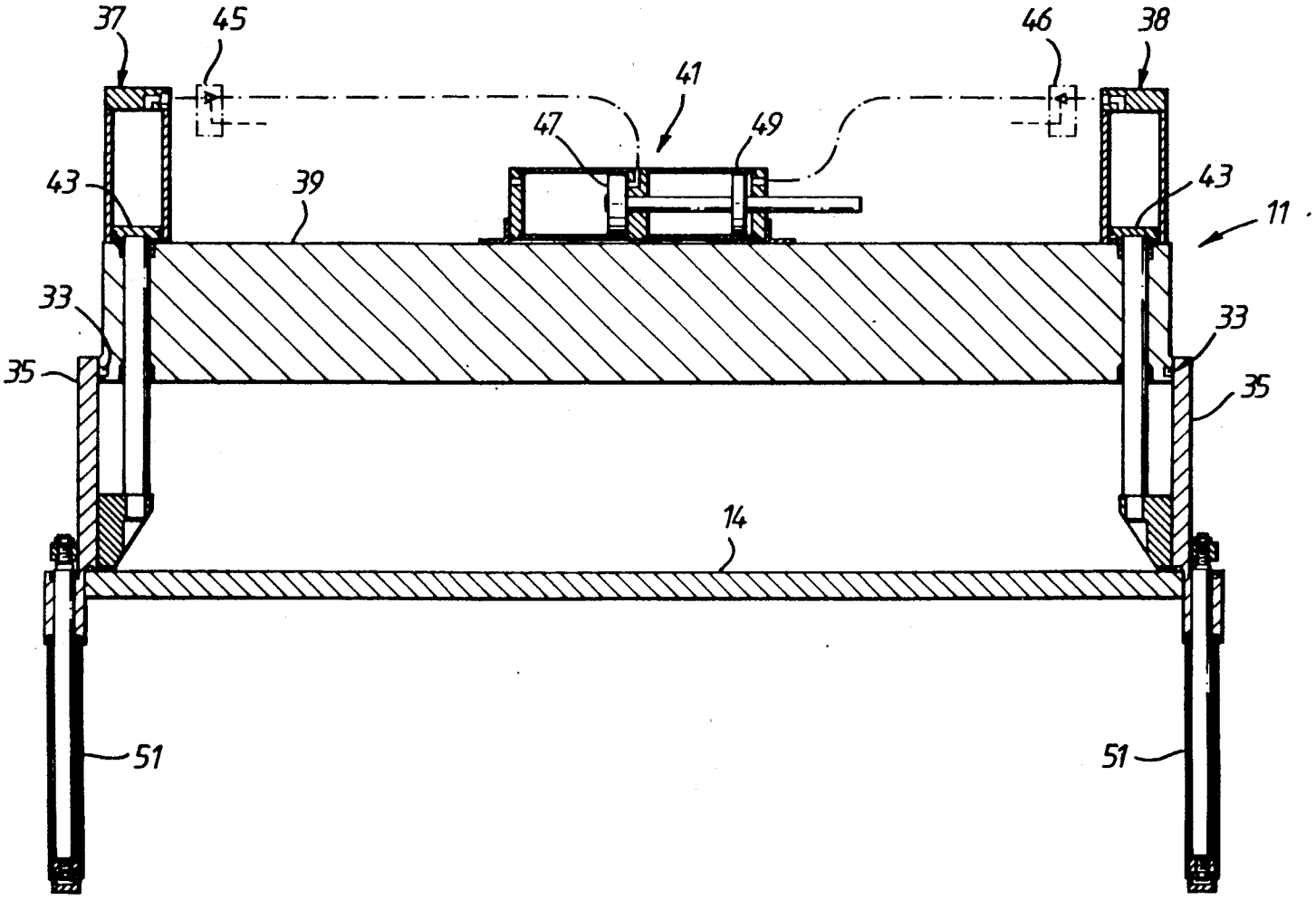
Figure 8:
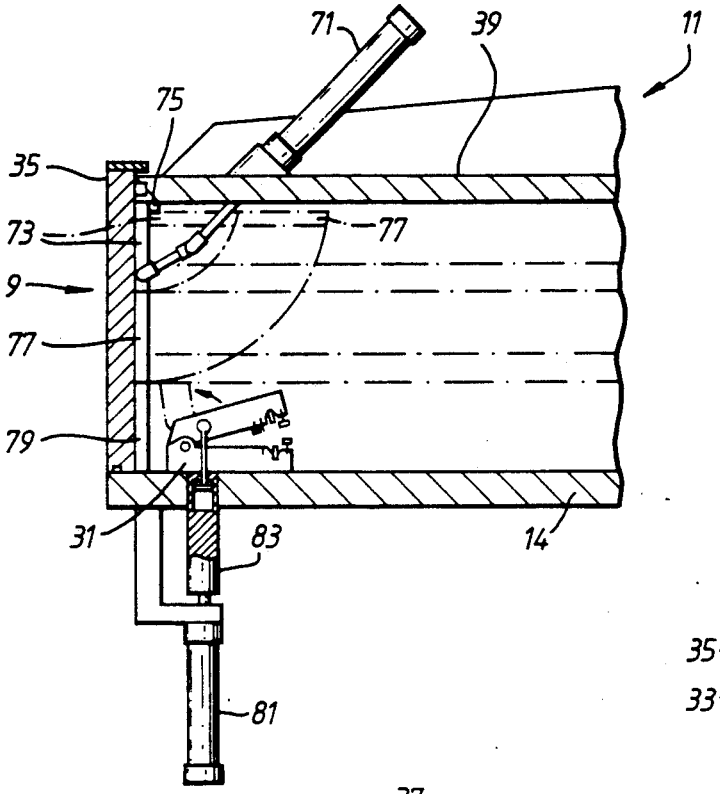
Figure 9:
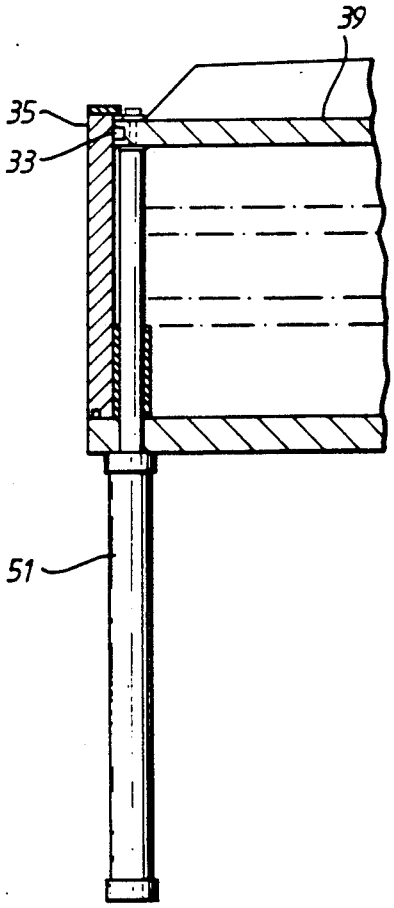
Figure 6:
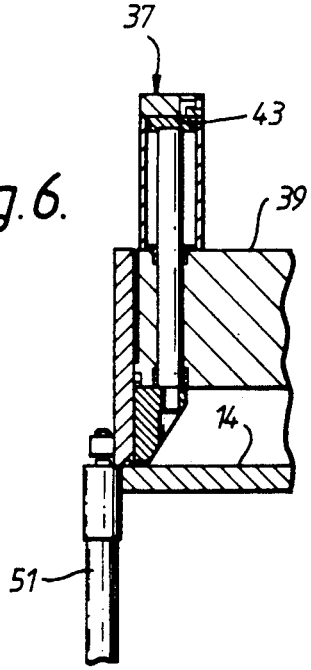
Figure 7:
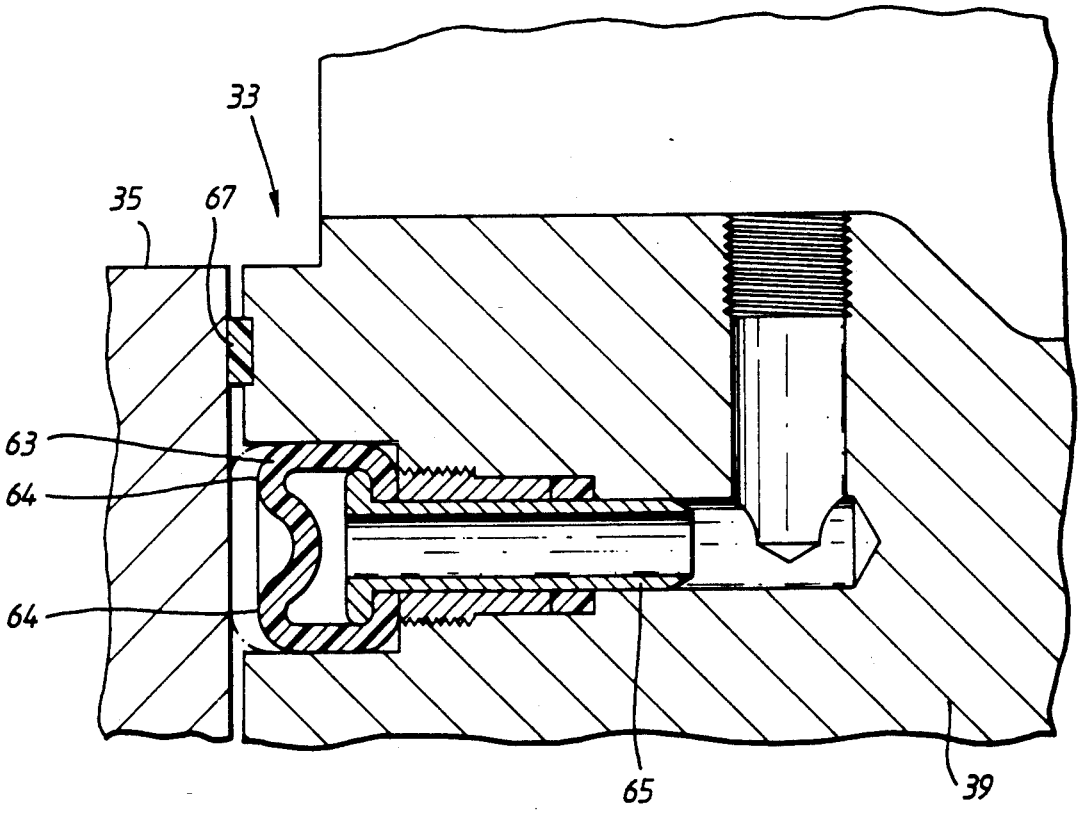

FIG. 3 is a sectional view of the apparatus of FIGS. 1 and 2 taken, on the line 3—3 of FIGS. 1 and 2;

FIG. 4 is a modified view of the section shown in FIG. 3, but illustrating in more detail the means for adjusting the height of the container closing jaws;

FIG. 5 is a view of the apparatus of FIG. 3 when viewed along the direction of the arrow 5 thereof;

FIG. 6 is a detail of FIG. 5 but showing the chamber cover in its minimum volume configuration;

FIG. 7 is a detail of the releasable seal shown in FIGS. 3 to 6;

FIG. 8 is a view corresponding to FIG. 3 but showing an alternative form of chamber cover volume variation means; and FIG. 9 is a view of the apparatus of FIG. 8 when seen along the direction of arrow 9 thereof.

FIG. 1 shows a general arrangement view of a vacuum packaging apparatus 1 comprising an elongate table having extending therealong a belt conveyor passing from a left-hand guide roller 3 to a right-hand guide roller 5 and shown as comprising a belt 7 on these rollers.

Pairs of bags on the belt 7 are delivered to a vacuum chamber area A with the bags of each pair side-by-side on the conveyor such that the mouths of the two bags of each pair are positioned adjacent the margins of the conveyor belt 7 and the sealed bottom ends of the bags are adjacent one another. The bags are thus in back-to-back arrangement on the belt 7. Several pairs in this configuration will normally make up one charge for the vacuum chamber.

Two lateral conveyor belts 9 are arranged close to and along the margins of the main belt 7 to support the open mouths of the succession of loaded packaging bags over the margins of the belt 7 as they pass rightwardly towards the vacuum chamber area A.

The paths of the belts 9 are adjustable vertically between a lower position 9 shown in solid lines and an upper position 9' in broken lines, in order that each lateral belt 9 can align the associated bag mouths with a cutting station 10 comprising rotating cutter wheels 12 which slice off surplus bag material to trim the mouths of the bag so as not to extend appreciably beyond the margin of the main conveyor belt 7. In this way, it is ensured that when the back-to-back bags of each pair enter the vacuum chamber area A the bag mouths will be totally enclosed within the area of the chamber cover. The cutter station includes an aspiration nozzle 26 connected to vacuum by way of a pipe which is shown schematically in FIG. 1 and illustrated in more detail in FIG. 2. Thus the nozzle 26 on each side of the main conveyor belt 7 is effective to remove the scrap which is severed by the cutter wheels 12.

A vertically movable vacuum chamber cover 11, coöperating with the main belt 7 to define the chamber, is positioned above the belt 7 and is carried for movement leftwardly and rightwardly between the solid line position shown on the right-hand side of FIG. 1, in an area of the machine referenced B, and a further extreme position to the left of the solid line position and marked by the intersection 13 between a leftwardly directed horizontal arrow 15 and a downwardly directed vertical arrow 17 intended to illustrate the left-hand end of the movement of the vacuum chamber cover 11. During its rightward movement (arrow 21 in FIG. 1) the cover 11 encloses several pairs of bags on the belt 7.

A similar pair of arrows (i.e. an upwardly directed vertical arrow 19 and a rightwardly directed horizontal arrow 21) near the boundary between regions A and B serves to illustrate, by means of their intersection point, arrival of the vacuum chamber cover 11 in the position shown in FIG. 1.

The longitudinal extent of the upper run of each of the two lateral belts 9 and 9' is varied in that as the chamber cover 11 moves rightwardly while closed down against the main belt 7 forming the floor of a vacuum chamber the right hand end of the upper run of each lateral belt 9 and 9' advances with the rear wall of the chamber to support the necks of the succession of pairs of bags which will form the next batch to be evacuated and are being advanced on to the zone A ready to be covered by rapid return movement of the vacuum chamber cover 11 from region B to region A once the vacuum cycle on the preceding batch has been completed. Means (not shown) accommodate the variation in length of this upper run of the lateral belts 9 and 9'.

The arrows 15, 17, 19 and 21 thus depict the movement of the chamber cover 11 during each vacuum cycle.

FIG. 1 also shows one of two suction nozzles 23 which can be swung into the chamber region A when the cover is raised, in order to help to remove further scrap material as will be explained later.

FIG. 2 shows that there is such a nozzle 23 on each side of the vacuum chamber cover 11 and that each of the nozzles 23 can be swung inwardly about an inclined axis to a broken line position 24 in which suction is applied adjacent the mouth region o the bag.

The important characteristic of the present invention which distinguishes it from the previously known vacuum chambers is that the volume of the vacuum chamber can be adjusted to conform to the height of the product in the bag to be evacuated and sealed. There may be automatic height sensing means, for example, comprising an electro-optical system using a plurality of beams which are intersected by the upper parts of the product such that the highest non-intersected beam chooses the height of available vacuum chamber configuration for use. Alternatively there may be a vertically reciprocating sensor comprising a light emitter sending a horizontal beam (for example of modulated light) across the bag path to a light receiver and thus recording the level of the beam at which the interruption of the beam is experienced as a result of the presence of the product article on the infeed conveyor belt 7, or at some upstream location, will indicate the product height. However, more probably, there will be a chamber height selection control to be operated manually to instruct the chamber height to change ready for a new product height.

When a change in the height of the vacuum chamber is required a seal, preferably an inflatable releasable seal 33, is released (e.g. deflated) while the vacuum chamber cover 11 is in its lowermost position and its sidewall portion 35 is seated on the conveyor belt 7. Height-adjusting rams 37 and 38 can then be operated in unison for raising and lowering the ceiling member 39 of the vacuum chamber cover to an appropriate new level.

FIG. 5 shows that there is a flow equalizing cylinder 41 mounted on the top of the ceiling member 39 for ensuring that the flow rates into and out of the two working chambers of the height-adjusting rams 37 and 38 are identical to ensure that the cover is at all times horizontal to minimize the possibility of wear of the working faces around the seal 33 between the ceiling member 39, on the one hand, and the vertical sidewall member 35, on the other hand.

FIGS. 5 and 6 illustrate well the operation of changing the height of the vacuum chamber cover 11 and from this it will be clear that when the chamber height is to be reduced the ceiling member 39 is allowed to descend and thus the pistons 43 in the rams 37, 38 will come closer to the top ends of the ram cylinders, expelling hydraulic fluid from the chamber of the ram 37 and 38 by way of respective pilot-controlled one-way valves 45 and 46 associated with the rams. As the hydraulic fluid leaves the ram chambers it enters the associated chamber to the right-hand side of the respective piston 47 or 49 of the flow-compensating cylinder 41, driving the piston pair leftwardly, but only at a rate such that the volume of fluid which has entered the chamber to the right of the piston 47 (i.e. from the cylinder of the ram 37 in FIG. 5), is the same as that which has entered the chamber to the right-hand side of the piston 49 (i.e. from the cylinder of the ram 38 on the right-hand side of FIG. 5).

When the appropriate level has been reached, the pilot-controlled one-way valves 45 and 46 are closed off to prevent further hydraulic fluid flow and thus to prevent further descent of the ceiling member 39 of the vacuum chamber cover 11.

At this stage, with the height of the chamber correctly set, the releasable seal 33 is re-engaged (reinflated) to re-establish the high vacuum seal between the ceiling member 39 and the sidewall member 35 of the vacuum chamber cover portion 11.

FIGS. 1 and 3 to 6 all illustrate the four rams 51 for raising and lowering the vacuum chamber cover portion 11 (comprising side wall member 35 and ceiling member 39) to open and close the chamber, and it will of course be understood that these rams are operated cyclically such that they lift the vacuum chamber cover portion 11 at the end of its rightward movement from the region A to the region B in FIG. 1 and begin to lower the vacuum chamber cover portion 11 towards the conveyor belt 7 at the left-hand end of the horizontal movement back from region B to region A, ready to start the next evacuation phase. The rams 51 are also operated in unison.

The configuration of the vacuum chamber cover portion 11 in its "minimum height" position is illustrated in FIG. 6 where the ceiling member 39 is close to the conveyor belt 7 and the ram 37 shown has its piston 43 virtually touching the upper end of the ram cylinder.

The height of the sealing jaws 31 in FIGS. 3 and 4 can be varied to accommodate different heights of product, by raising and lowering the rams 27 (by means not shown) whereupon operation of the rams themselves can then initiate opening and closing of the jaws 31 at the chosen level.

FIG. 4 also shows that each jaw 31 includes (i) an inner pair of pressure pads 53 to hold closed together the two superposed walls of the bag adjacent the intended line of seal for the bag mouth, (ii) two closely spaced pairs of sealing bars 55 and 57 serving to seal the bag walls together to close the mouth, (iii) a severing knife 59 to remove surplus bag material from a position very closely adjacent the line of seal (in practice of the order of a few millimeters), and finally (iv) a hold-down member 61 which holds the thus severed scrap material in place until the jaw 31 starts to open and the aspiration nozzle 23 described earlier is in position adjacent the sealing jaws for removing that scrap material.

FIG. 7 shows that the seal 33 extending right around the join between the periphery of the ceiling member 39 and the sidewall member 35 of the vacuum chamber cover 11 is in this case formed of a continuous tubular sealing member 63 having associated therewith a nozzle 65 for allowing a pressurizing fluid to be introduced into the tubular sealing member 63 to thrust the seal member 63 into firm engagement with the inwardly facing surface of the sidewall member 35 of the vacuum chamber cover 11.

The inflatable tubular sealing member 63 preferably has its relaxed configuration as shown in FIG. 7, i.e. with the convex corners 64 spaced inward from the sidewall member 35 and with a concave portion therebetween. Whenever the inflation pressure inside the sealing member 63 is relaxed the member will revert to this configuration to ensure no impediment whatsoever to the sliding of the ceiling member 39 relative to the sidewall member 35 by contact with the inflatable sealing member 63, and equally no damage to the sealing member 63 during such sliding.

FIG. 7 also shows an sliding guide pads 67 of polytetrafluoroethylene which help to maintain the ceiling member horizontal during the adjustment process.

One sequence of operation of the machine 1 of FIGS. 1 to 7 will now be described by way of example.

A succession of pairs of bags is placed on the conveyor belt 7, just to the right of the belt-supporting roller 3, and arranged with the closed ends of the bags adjacent one another.

As the conveyor belt 7 carries this pair of bags rightwardly towards the pre-cutting station 10, the upward inclination of the lateral belt 9 on each side of the main conveyor belt 7 lifts the level of the bag mouth towards that which is finally required for the line of seal.

When each pair of bags arrives at the pre-cutting station 10, the engaging cutter wheels 12 sever the surplus bag material so that the open end of the bag will now be accommodated within the vacuum chamber cover 11. The severed scrap material is sucked away along the aspiration pipe 26.

Once the belt 7 has taken the several pairs of bags rightwardly into the region A and the vacuum chamber cover 11 has moved on to region B, the cover 11 will move rapidly leftwardly to be positioned above the batch of bags so that the cover may then descend onto the belt 7 (on the base plate 14) defining the chamber floor for closing the chamber. The height previously selected for the vacuum chamber cover 11 will be appropriate for that of the products in the bags so that no unnecessary air space needs to be evacuated during the next operation. The vacuum chamber cover 11 immediately starts advancing with the belt 7 towards the region B while the next batch of bags begins to assemble in the region A.

Vacuum is then applied once the vacuum chamber cover 11 is down, following operation of the rams 51 so that the chamber cover 11 is in contact with the base plate 14 (FIG. 5) and vacuum begins to be applied as the base plate 14 and cover 11 progress horizontally along the machine towards the vacuum chamber region B.

At an appropriate point just before the chamber cover 11 and the belt 7 reach their right-hand position in the region B (shown in solid lines in FIG. 1), the rams 27 are operated to close the sealing jaws 31 and the heat sealing bars 55 and 57 are energised to seal the bag material layers against one another while they are held by the pressure pads 53. At the same time the severing knife 59 will remove the remaining thin strip of scrap material (not removed at the pre-cutting station 10 in case too much material had been removed and the sealing operation would be ineffective), and this severed material is then held down by the pads 61.

The vacuum under the chamber cover 11 is then vented and the chamber cover 11 begins to rise while the jaws 31 are still held closed.

At an appropriate point during the raising of the chamber cover 11, the aspiration nozzles 23 swing inwardly and are subjected to suction so that as the jaws 31 pass the nozzles 23 during leftward movement of the chamber cover 11 the pads 61 release the recently severed scrap material to be aspirated by the nozzles 23 to waste (or for recycling if this is feasible).

The chamber cover 11 then rises to allow the further advance of the sealed bags towards the roller 5 at the delivery end of the machine table for delivery of the sealed bags.

Meanwhile, the completely raised chamber cover 11 moves leftwardly to repeat the operation on the next batch of bags.

If desired, the vacuum chamber may be designed so that it only accommodates one pair of loaded bags, or even only one bag, at a time, but the larger size is preferable as further optimising the use of vacuum and increasing process speed in that the chamber is only evacuated once for every set of pairs of bags being evacuated and sealed.

When a different height of product is to be handled the releasable seals 33 are deflated, and the rams 37 and 38 are operated to set the level of the ceiling member 39 at the appropriate height relative to the sidewall member 35.

If the ceiling member 39 is to be lifted for the new position of adjustment required, then hydraulic fluid is pumped back from the chambers of the equalizing cylinder 41 into the chambers in the rams 37 and 38, for example by applying compressed air to the left hand sides of the pistons 47 and 49 of the equalizing cylinder 41.

Simultaneously with the adjustment of the height of the chamber cover ceiling member 39, the levels of the rams 27 of FIG. 4 will be changed so that the plane of sealing between the heat sealing bars 55 and 57 of the jaws 31 will be at the optimum height. For regular products the optimum may be the median height (half way between the bottom and the top) of the product in which case the height selection for the sealing pairs may be linked to the chamber height selection so that the sealing will always be at median height.

However, for non-regular products some other height may be appropriate in which case selection of the sealing level is best left independent of the chamber height.

The level of the pre-cutting station lo and the height of the lateral support belts 9 in the vicinity of the pre-cutting station 10 will preferably be adjusted to the same height, so that the open bag mouths will be introduced into the left-hand vacuum chamber region A at the correct level to enter the space between the fixed lower jaw member and the movable upper jaw member of each of the sealing jaws 31 with minimum risk of fouling against the ends of the jaw members. Adjustment of the height of the aspiration nozzles 23 (FIGS. 1 and 2) to match the height of the jaws 31 can also be automatically effected, so that when the aspiration nozzles 23 are swung inwardly to the broken line position 24 (FIGS. 2 and 3) they will be correctly aligned with the vicinity of the scrap material which has just been severed by the knife 59 of the respective closing jaw 31.

An alternative and somewhat simplified form of the vacuum chamber cover height adjustment mechanism is illustrated in FIGS. 8 and 9 in which on each side of the chamber a first ram 71 drives a spacer plate 73 for pivoting motion around a pivot axis 75 just under the periphery of the chamber cover ceiling member 39 and a second similar ram 71 (not separately visible in FIG. 8) drives a longer spacer plate 77 about the same pivot axis 75.

The radius of the shorter spacer plate 73 is equal to one third of the maximum height of the vacuum chamber cover 11, while the radius of the longer spacer plate 77 is equal to two thirds of that height.

There is, furthermore, a fixed spacer plate 79 fastened to the inside surface of the sidewall member 35, at the bottom, again having a height equal to one third of the maximum chamber cover height.

A ram 81 associated with each clamping jaw assembly is operated to raise and lower the clamping jaw relative to the base plate 14 under the belt 7, while a further ram 83 associated with the same clamping jaw serves to drive the clamping jaw 31 between its open and closed positions.

Otherwise, the chamber adjustment mechanism of FIGS. 8 and 9 is equivalent to that shown in FIGS. 1 to 6 in that there is still a sliding seal 33 between the ceiling member 39 and the sidewall member 35, and also rams 51 to raise and lower the sidewall member 35 and hence the entire chamber cover 11.

As will be evident from FIGS. 8 and 9, when all of the longer spacer plates 77 and the shorter spacer plates 75 are raised there will be a minimum chamber height, defined by the fixed spacer plate 79, equal to one third of the maximum height.

When only the shorter spacer plates 73 are lowered, they can descend into contact with the fixed spacer plates 79 upon descent of the ceiling member 39 to define a chamber height which is two thirds that of the maximum value.

Finally, when the longer spacer plates 77 (e.g. instead or as well as the shorter plates 73) are lowered and the chamber ceiling member 39 is lowered so that they abut the top of the fixed spacer plates 79, the height of the chamber cover 11 will be set to its maximum value.

This provides a much simplified form of adjustment mechanism with only three available heights, but can be used to accommodate a range of different product heights.

In such cases where it is known that the products to be handled by an apparatus will fall in approximately three general classes of height value which are other than precise multiples of thirds of the height of the tallest product, that chamber cover may be equipped with special spacer suitably dimensioned plates 73, 77 and 79 which allow the particular values to be predetermined and rapidly selected at will.

Although the present invention has been described in terms of a bag sealing device, it will be evident to the expert in this art that it may readily be adapted for use with vacuum packs of other types, for example those formed of upper and lower sheets which are sealed around their entire peripheries to enclose a product under vacuum.

The releasable seal system may additionally or alternatively be employed with a movable floor chamber bottom, for example where thermoformed trays of variable depth are to be subjected to a vacuum chamber process.

I claim:

1. Vacuum packaging apparatus comprising:

(a) a vacuum chamber having a base member and a cover member movable relative to one another for opening and closing the vacuum chamber;

(b) at least one of the base and cover member s comprising first and second parts which can be repositioned relative to one another to define a minimum chamber volume configuration and a maximum chamber volume configuration, (c) a releasable seal between said parts for maintenance of sealing between said parts after readjustment and, (d) means for releasing the seal prior to and during readjustment of the chamber volume and re-engagement of the seal between said parts after selection of a new chamber volume.

2. Apparatus according to claim 1 including means for adjusting the volume of said at least one of the chamber portions which comprises a plurality of rams arranged for driving one of said relatively movable members relative to the other for defining a new chamber volume.

3. Apparatus according to claim 1 wherein said first part is the sidewall assembly of the chamber cover and the second part is a ceiling member slidable relative thereto.

4. Apparatus according to claim 3, wherein said seal comprises a tubular sealing member extending around the periphery of the ceiling member and positioned to contact an adjacent surface of the sidewall assembly upon inflation of the tubular sealing member, and said seal releasing and reengaging means comprise means for inflating the sealing member for sealing engagement with said surface of the sidewall assembly when a desired level of the ceiling member relative to the sidewall assembly has been selected.

5. Apparatus according to claim 2 including vertically movable sealing means for closing and sealing the package around a said product, and means for adjusting the level of said sealing means in response to the selected volume of a vacuum chamber.

6. Apparatus according to claim 2, and including means for ensuring that the degree of extension and/or contraction of the or each said ram is the same for all of the rams simultaneously.

7. Apparatus according to claim 2 wherein said means for adjusting the chamber volume of said at least one chamber member includes alternative spacer means to define different relative positions of said relatively repositionable parts to correspond to different chamber volumes, and means for selecting an appropriate one of said spacer means for positioning the said parts with respect to one another.

8. Apparatus according to claim 2 including means for sensing the height of a product about to be packaged, and effective to control said adjustment means to select an appropriate chamber volume for said sensed product height.

9. Apparatus according to claim 5, wherein said means for adjusting the level of said sealing means are linked to the chamber volume adjustment means to maintain the sealing means at the median level of said package to be formed around the product.

10. Apparatus according to claim 5 or claim 9, and including means for feeding the product with its container in open configuration into a position in said vacuum chamber, and means for adjusting the level of said feed means to ensure that the level of the portions of said container to be sealed for closing the pack enter the chamber at the same level as said sealing means.

11. Apparatus according to claim 10 wherein said sealing means include severing means for removing scrap material outside the line of sealing, after closing of the container, and aspirator means for extracting the scrap material severed by the severing means, said aspirator means being adjustable in height to be effective at the selected level for said sealing means in the vacuum chamber.

12. Apparatus according to claim 10, and including severing means for severing scrap material from said open container portion being fed to the sealing means, said scrap severing means being adjustable in level to correspond with the level of said sealing means and of said feed means.

* * * * *